United States Patent [19]

Lisnay et al.

[11] 4,024,482

[45] May 17, 1977

[54] CIRCUIT BREAKER

[75] Inventors: Albert D. Lisnay, Trenton; Keith L. Schilling, Irvington, both of N.J.

[73] Assignee: Heinemann Electric Company, Trenton, N.J.

[22] Filed: Feb. 4, 1975

[21] Appl. No.: 547,046

[52] U.S. Cl. ..... 335/169; 335/59; 335/173

[51] Int. Cl.[2] ..... H01H 9/24

[58] Field of Search ..... 335/62, 63, 59, 239, 335/240, 167–171, 174

[56] References Cited

UNITED STATES PATENTS

| | | | |
|---|---|---|---|
| 3,017,475 | 1/1962 | Smith | 335/63 |
| 3,693,121 | 9/1972 | Carpenter et al. | 335/169 |

*Primary Examiner*—Harold Broome

*Attorney, Agent, or Firm*—Joseph G. Denny, III; Peter J. Patane

[57] ABSTRACT

An electrical circuit breaker comprising an electromagnetic device including a linearly movable armature and a linearly movable time delay assembly. The time delay assembly has a forward end portion which carries a lever. The forward end portion includes a catch to latch the movable contact arm in the contacts "on" position. On predetermined electrical conditions, the armature moves linearly, engages the lever, which then pivots and engages the movable arm, moving the latter out of engagement with the catch, whereupon the contacts open. The contacts may be opened manually by rotating the time delay assembly, whereupon a portion of the assembly engages the movable arm and moves the latter out of engagement with the catch, and the contacts then also open. The contacts, in both instances, may be manually reclosed by moving the time delay assembly toward the contacts, if the electromagnetic device is no longer energized sufficiently to trip open the circuit breaker.

79 Claims, 21 Drawing Figures

FIG. 1
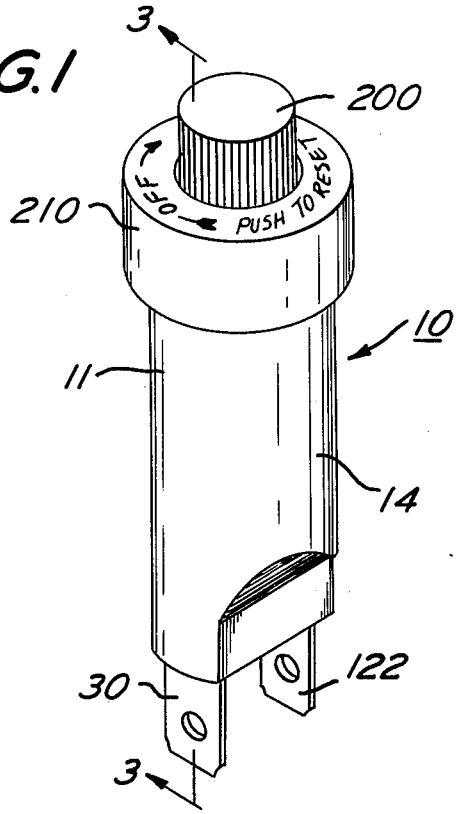
FIG. 2
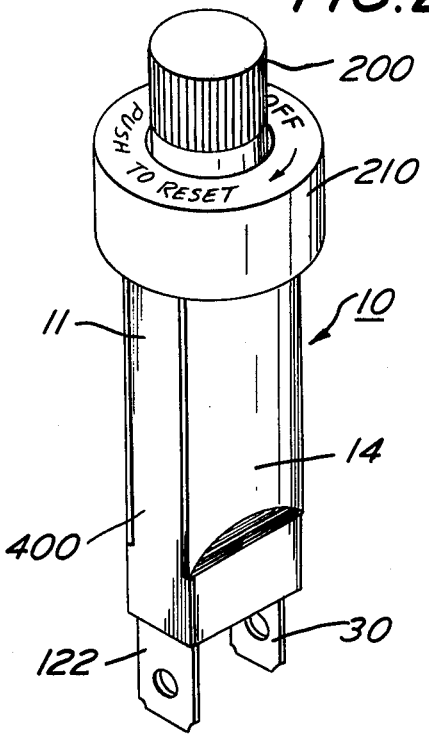
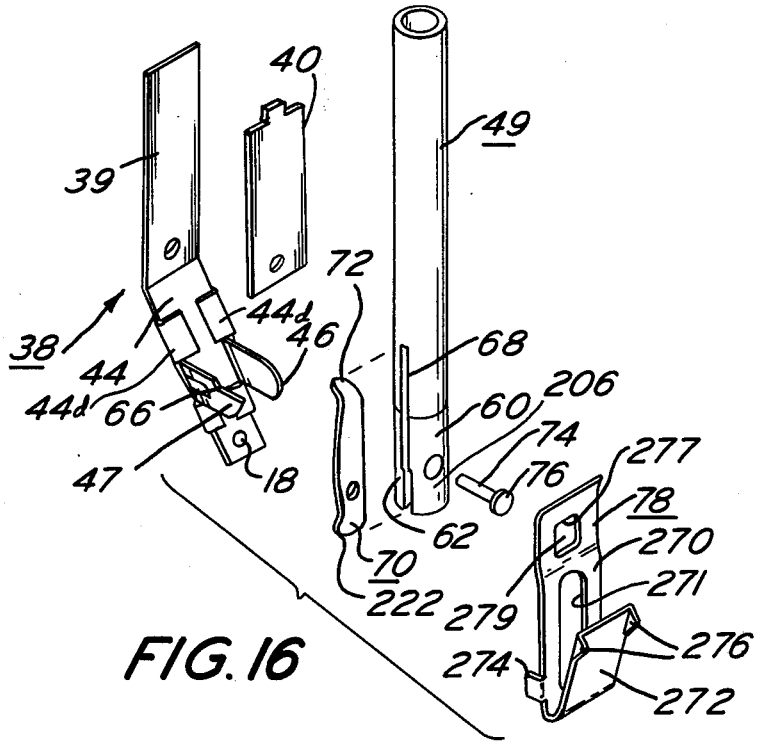
FIG. 16

FIG. 9
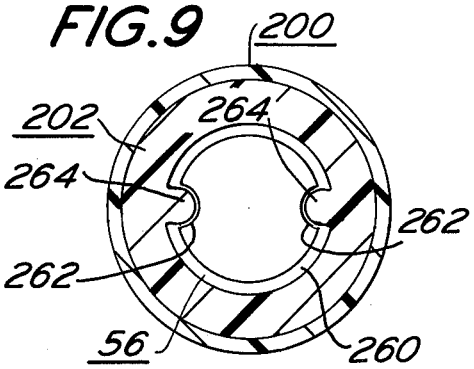
FIG. 13
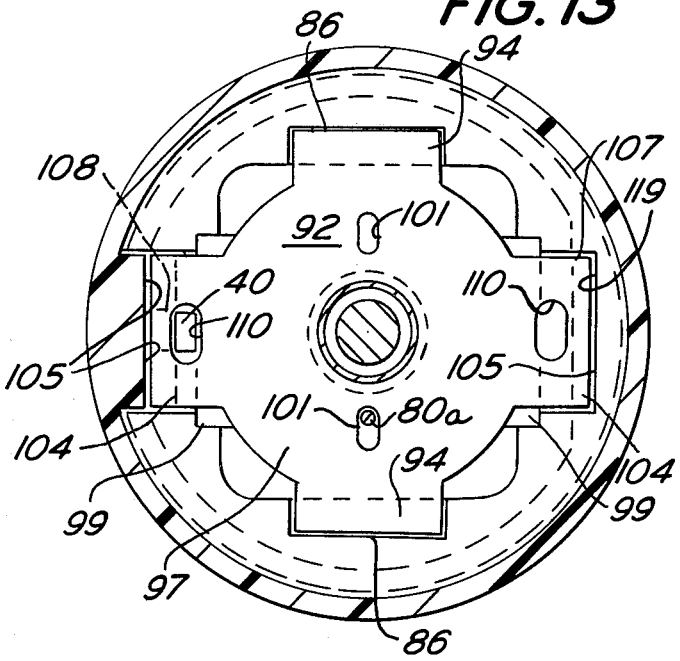
FIG. 10
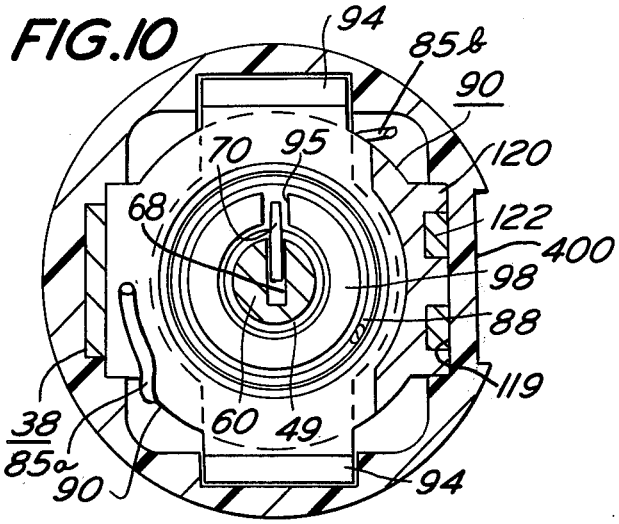
FIG. 11
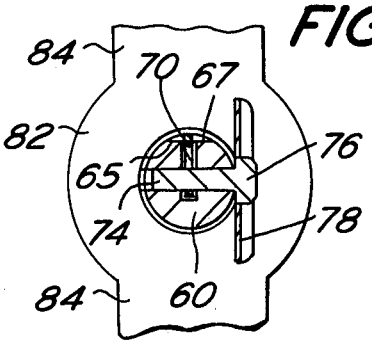
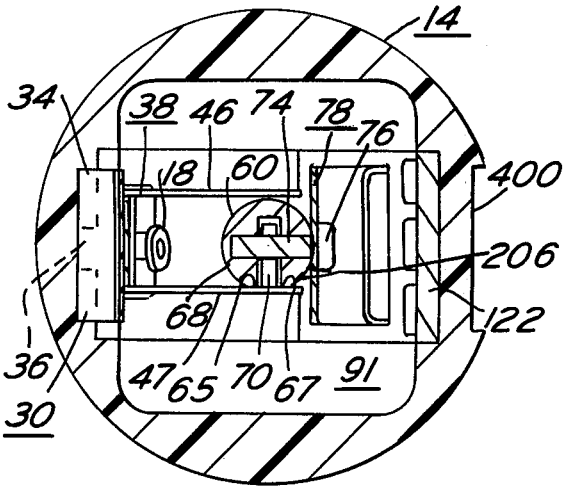
FIG. 12
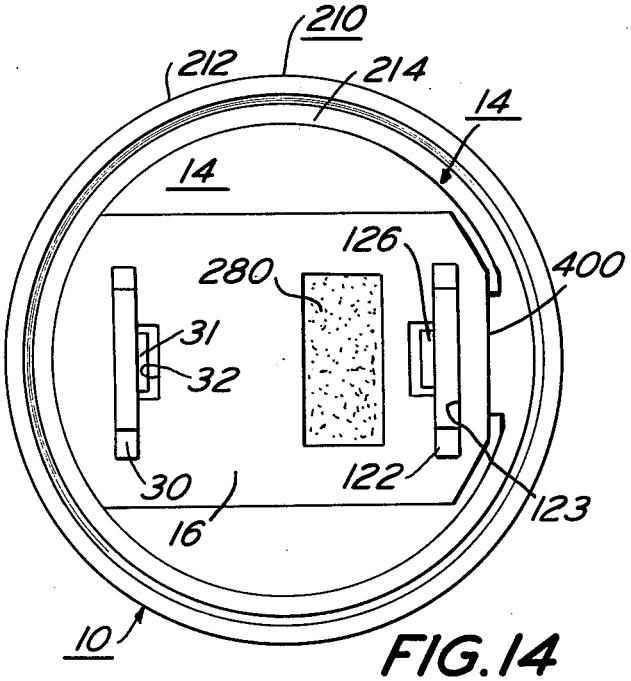
FIG. 14

FIG. 18
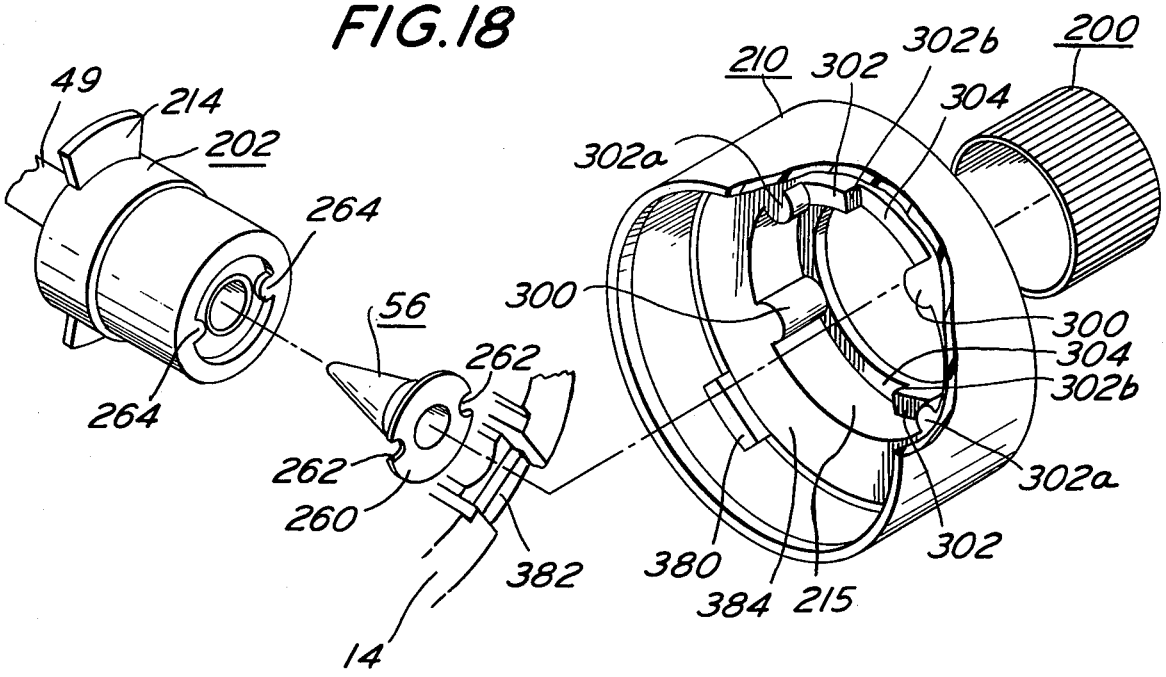
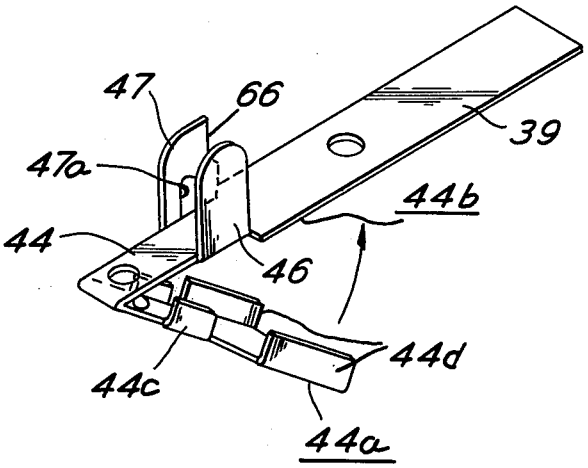
FIG. 19

CIRCUIT BREAKER

BACKGROUND OF THE INVENTION

This invention relates to small, but fully electromagnetic, circuit breakers.

Many electrical circuit interrupters of the fuse or thermal type have a long, cylindrical shape. These long cylindrical fuse or thermal circuit protectors are widely used to protect domestic appliances and many other electrical items.

It is an object of this invention to provide a circuit breaker of the electromagnetic type having an outside, generally cylindrical envelope configuration and generally of a size which is similar to the previously known fuse or thermal protectors.

It is a further object to provide such an electromagnetic circuit breaker which will open the circuit after a time delay period at certain electrical conditions and substantially instantaneously at other, electrical current conditions.

The size of the intended unt is one in which the housing will be about ¾ inch (about 1.9 km) in maximum outside diameter and the overall length, including terminals, is about 2 inches (about 5.08 cm) long. Hence, the size of the electromagnetic coil is limited to one of relatively few turns because of the small overall size of the circuit breaker, and, since the current involved is low, about 20 amperes or less, the magnetic force produced will be low relative to a larger size circuit breaker. Thus, it is a further object of this invention to provide a mechanical arrangement for utilizing a low electromagnetic output to trip open the circuit breaker contacts.

A still further object is to provide a simplified linkage mechanism for an electromagnetic circuit breaker for use in a long, cylindrical housing.

As is well known, time delay tubes have been used in electromagnetic circuit breakers to provide a time delay, on certain electrical conditions, before the contacts are opened. In order to minimize the number of parts, it is another object of this invention to use the time delay tube as a part of the linkage mechanism for manually opening and closing the circuit breaker.

It is contemplated that the circuit breakers made in accordance with this invention will be rated at about 20 amperes at 120 volts A.C., at about 10 amperes at 240 volts A.C., and at about 20 amperes at 32 volts D.C., although it is not intended to limit this invention to these particular ratings or electrical conditions.

SUMMARY OF THE INVENTION

A circuit breaker is provided comprising a housing enclosing a pair of separable contacts. An electromagnetic device includes a time delay assembly having a portion extending through the housing for manually opening and closing the contacts.

The time delay assembly has a second portion which includes a catch for restraining the movable arm in the contacts closed position. This second portion of the time delay assembly carries a lever which on predetermined electrical conditions engages the movable arm and releases it from the catch.

A latch restrains the time delay assembly in the contacts closed position. When the movable arm is released from the catch, it impinges on the latch and releases the time delay assembly which then moves to its contacts open position.

The movable arm may also be released from its catch by rotating the time delay assembly at which time a third portion of the time delay assembly engages the movable arm and raises the movable arm off the catch, whereupon the contacts open.

The foregoing and other objects of our invention, the principles of our invention, and the best modes in which we have contemplated applying such principles will more fully appear from the following description and accompanying drawings in illustration thereof.

BRIEF DESCRIPTION OF THE DRAWINGS

In the drawings:

FIG. 1 is a front and top perspective view of the improved circuit breaker of this invention;

FIG. 2 is a back and top perspective view of the circuit breaker shown in FIG. 1;

FIGS. 9, 10, 11 and 12 are cross-sectional views taken along the lines marked with corresponding numbers in FIG. 3;

FIG. 13 is a cross-sectional view taken along the line marked 13—13 in FIG. 4;

FIG. 14 is an end view of the circuit breaker taken along the line 14—14 in FIG. 4;

FIG. 16 is a partial, exploded view showing the movable contact arm, the bracket therefor, the time delay tube and its extension, the lever, the pin and the latch;

FIG. 18 is an exploded view of the button, the plug, the cover, and the cap, the cover being partially cut away to show some of its internal wall structure;

FIG. 19 is a perspective view of the movable arm showing it prior to its being completed;

DESCRIPTION OF THE PREFERRED EMBODIMENT

Figure 3:
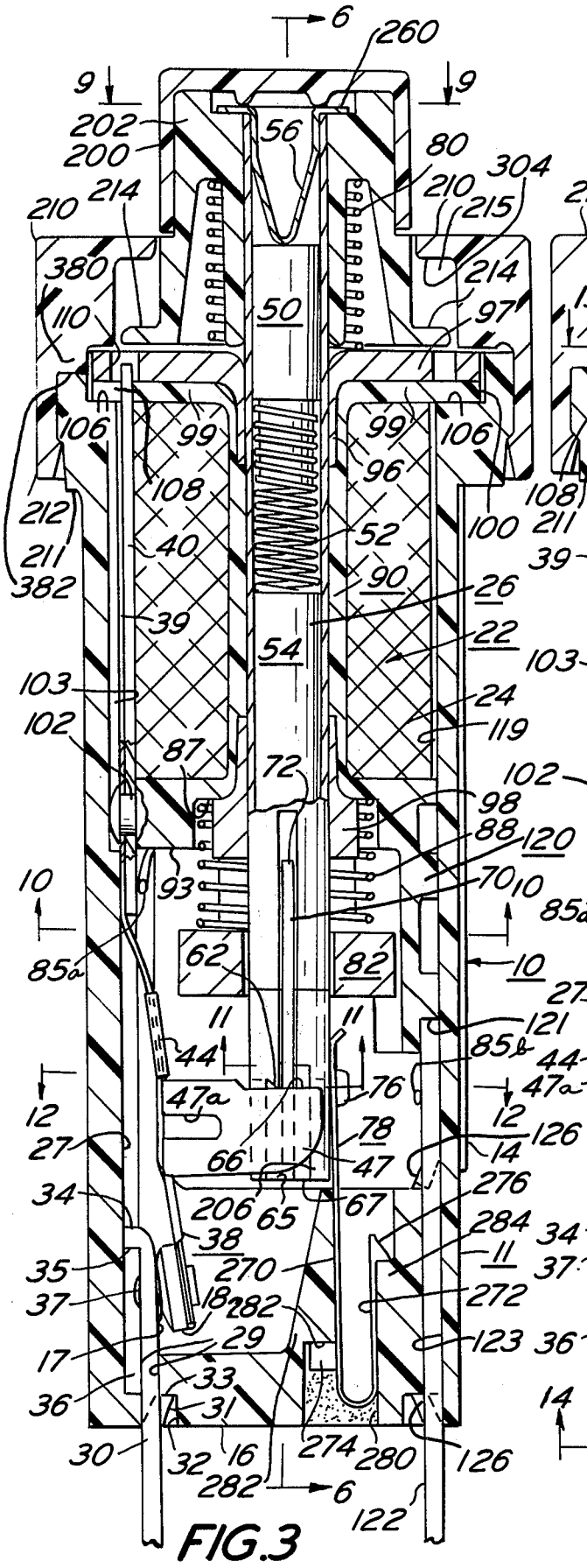
FIG. 3 is an enlarged, relative to FIGS. 1 and 2, sectional view taken along the line 3—3 in FIG. 1 and showing the contacts closed position of the circuit breaker.

Referring to the drawings, FIG. 1 is a perspective, front illustration of the new circuit breaker 10 of this invention in the contacts closed position, i.e., the cap 200 is depressed.

Figure 4:
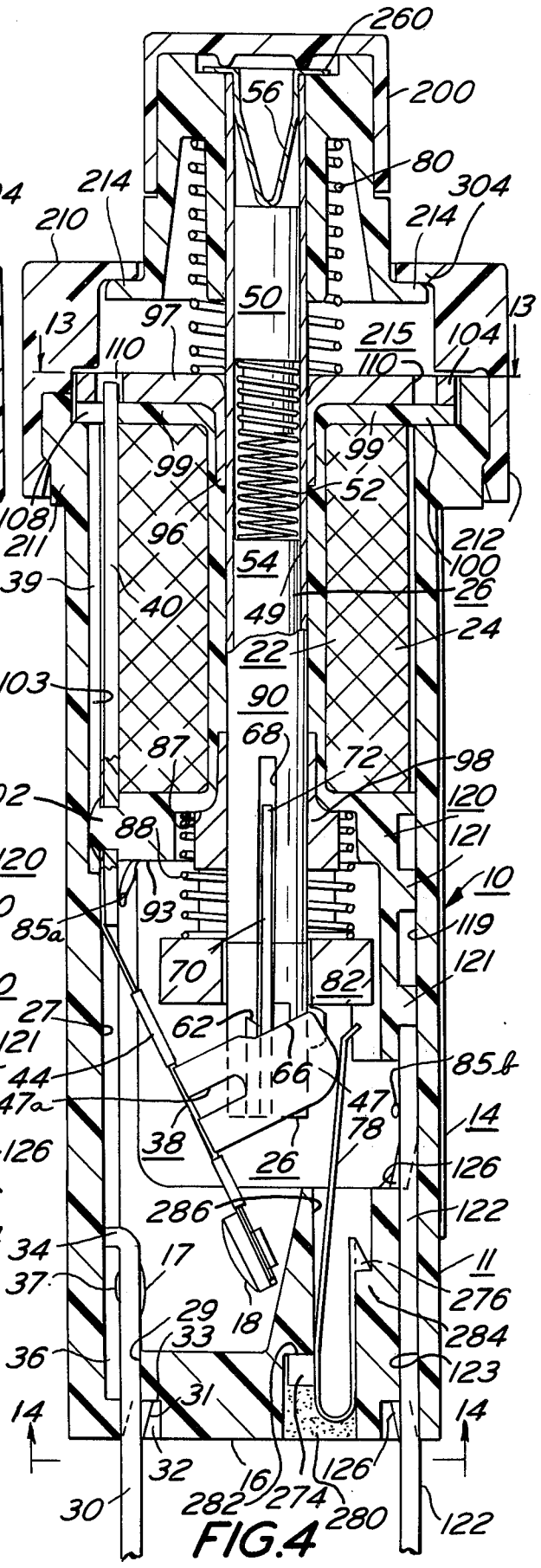
FIG. 4 is a sectional view, similar to FIG. 3, but showing the contacts open position of the circuit breaker.

The circuit breaker 10 includes an elongated housing 11 comprising a case 14 of suitable electrical insulating material, preferably a molded plastic case. The case 14 is in the general shape of an elongated cylinder having a closed base 16 (FIGS. 3, 4, 14 and 15) at its lower end, the case 14 being open at the upper end. Adjustable the base 16 is a stationary contact 17 and a movable contact 18. The open, upper end of the case 14 is partially closed by a cover 210, as shown in FIGS. 3 and 4.

Within the housing 11 is placed an electromagnetic sensing device 22 comprising a solenoid coil 24 and a linearly movable time delay assembly 26, the latter including a linearly movable elongated tube 49 for opening the contacts 17 and 18 after a time delay period on predetermined electrical conditions or virtually instantaneously at other electrical conditions. Also, as hereinafter described, the time delay assembly 26 is manually rotatable to manually open the contacts 17 and 18. The time delay assembly 26 is also linearly movable toward the stationary contact 17 to manually close the contacts.

The stationary contact 17 is mounted upon a stationary terminal 30 (the line terminal). Preferably, the terminal 30 is snugly received in a suitable slot 29 (in the base 16) and is inserted from the top, as viewed in FIG. 3, into the case 14 until a raised, sloping section 31 (bent out from the terminal 30) snaps past the slot 29 into the enlarged slot 32, as shown, at which time it abuts a shoulder 33 to limit upward travel of the terminal 30. Downward travel of the terminal 30 is limited by a bent tab 34 slidably received in a channel 27 open at its upper end and communicating with a groove 36 at its lower end. The tab 34 rests upon a shoulder 35 formed on the case 14, as shown in FIGS. 3 and 4. The groove 36 is provided to receive the rear portion 37 of the contact 17 which is riveted, preferably, to the terminal 30.

The movable contact 18 is preferably riveted to a movable arm 38 which has a rear section 39 by which it is secured to a bracket 40 carried by a bobbin 90, the latter forming part of the electromagnetic sensing device 22. Further, the movable arm 38 has a forward section 44 (upon which the contact 18 is mounted) which is movable toward and away from the stationary contact 17.

The bracket 40 is preferably formed of non-magnetizable material. The movable arm 38 is preferably formed from a single piece of suitable electrically conductive material, preferably non-magnetizable, as hereinafter described in further detail.

Figure 17:
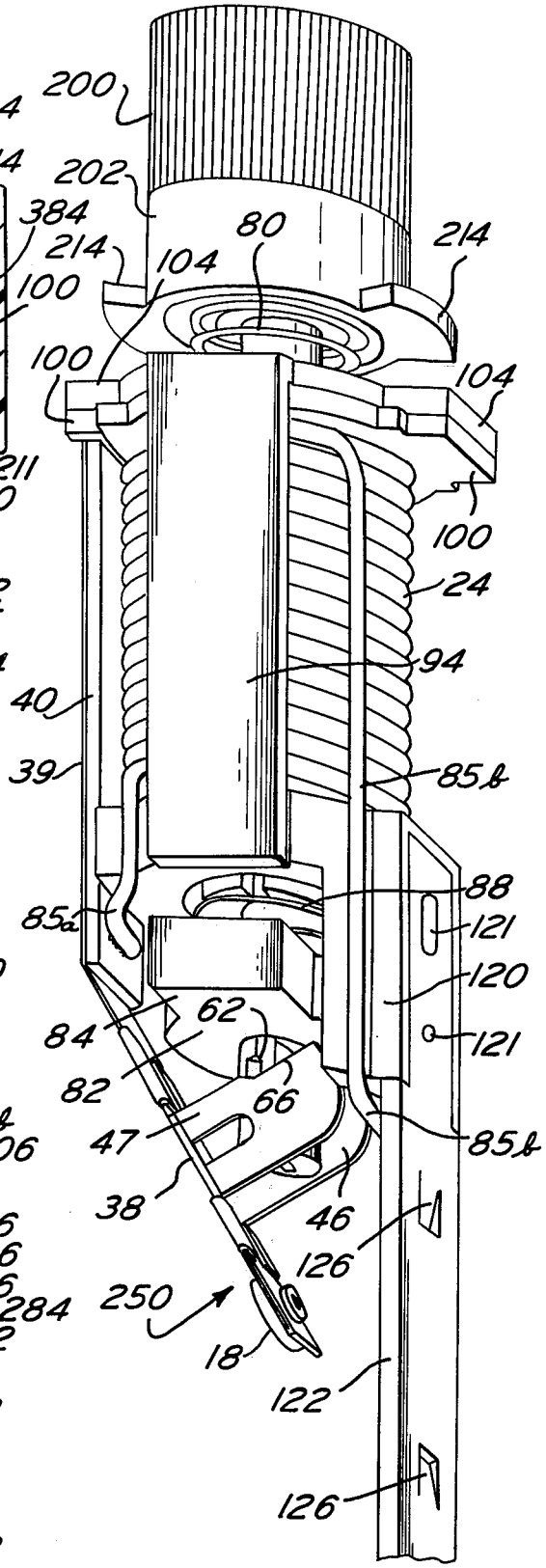
FIG. 17 illustrates the internal sub-assembly of the circuit breaker of this invention.

Also the movable arm 38 has two wings 46 and 47 extending from the forward section 44 and on opposite sides thereof toward an elongated extension 60 carried by a movable, elongated tube 49, so as to straddle opposite sides of the extension 60. The wing 47 is preferably formed with a slot **47*a*, as shown in FIGS. 3, 4 and 17,** for increased flexibility.

The time delay assembly 26 is disposed along the longitudinal axis of the housing 11, as seen in FIG. 3, and is coaxial with the coil 24. Further the time delay assembly 26 comprises the tube 49 which houses a movable magnetic core 50 biased to the upper end of the tube 49 by a spring 52. The core 50 moves, on predetermined electrical conditions, down toward a pole piece 54 of magnetizable material, the pole piece 54 being soldered thereto or otherwise suitably secured to the lower end of the tube 49 and sealing the tube 49 at this end. Upon sufficient energization of the coil 24, the core 50 moves toward the pole piece 54 against the retarding action of a fluid within the tube 49, preferably a silicone liquid, the core 50 being biased toward its initial position by the spring 52. The tube 49 is sealed at the upper end by an inverted, conically-shaped plug 56 which also functions as a stop defining the initial or upper position of the core 50. For clarity of illustration, the fluid within the tube 49 is not illustrated in the drawings.

Preferably the tube 49 and the extension 60 are both of non-magnetizable material. The pole piece 54 and the extension 60 are preferably placed in abuttment with each other and notched so as to receive a solder ring 59 by which they are soldered to the tube 49.

Figure 6:
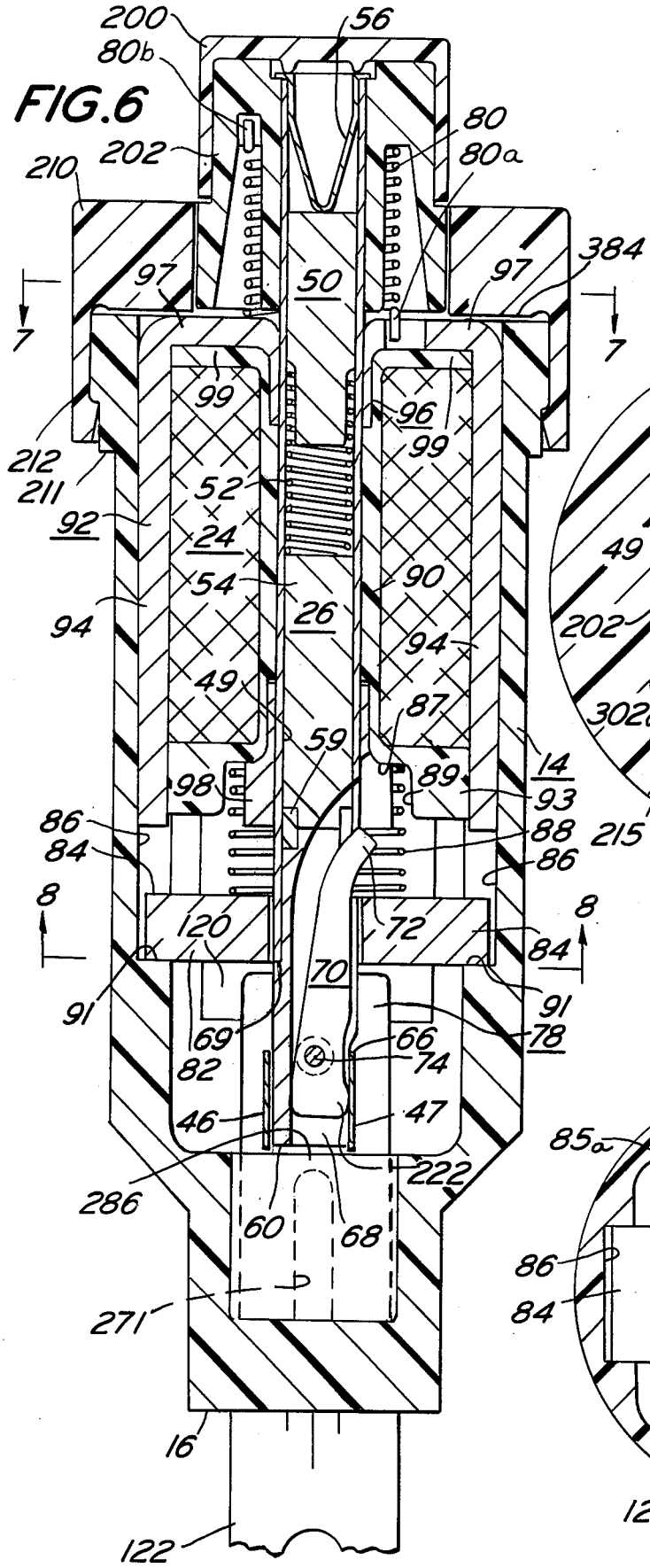
FIG. 6 is a further sectional view taken along the line 6—6 in FIG. 3.

The extension 60, as shown in FIGS. 3, 11, 12 and 16, is formed from a solid rod with a cylindrical outer surface which is cut away to form a flat surface 65 and an inclined surface forming a shoulder or catch 62 at its lowermost portion which receives and restrains the notched edge surface 66 of the wing 47, as shown in FIG. 3, so as to bias the arm 38 and its movable contact 18 toward the stationary contact 17 and thereby maintain the contacts 17 and 18 in the closed position when the time delay assembly 26 is in its lowest (or forwardmost) position, as viewed in FIG. 3. Preferably the extension 60 has a notch 69 (as shown in FIG. 6) to receive the tube 49 so that the two of them form a continuous, cylindrical outer surface.

Further, the extension 60 and the pole piece 54 carry an elongated, pivotal lever 70, preferably placed in an elongated slot 68 formed in the extension 60 and in the pole piece 54. In the contacts closed position, FIG. 3, the lever 70 is housed entirely within the slot 68, as shown in FIGS. 3, 4 and 6, except for a projecting tail 72, hereinafter further described. The portion of the extension 60 to the right of the slot 68 (as viewed in FIGS. 3, 4 and 5) is also cut back to form a second flat surface 67, FIGS. 3 and 12, so as to not interfere with the wing 47.

The lever 70 is pivotally connected to the extension 60 by a pin 74, as shown in FIGS. 6, 11, 12 and 16, the pin 74 having a head 76 which catches on a latch plate 78 to restrain movement of the time delay assembly 26 out of the housing 11. Preferably, the pin 74 is frictionally secured to the extension 60.

Figure 15:
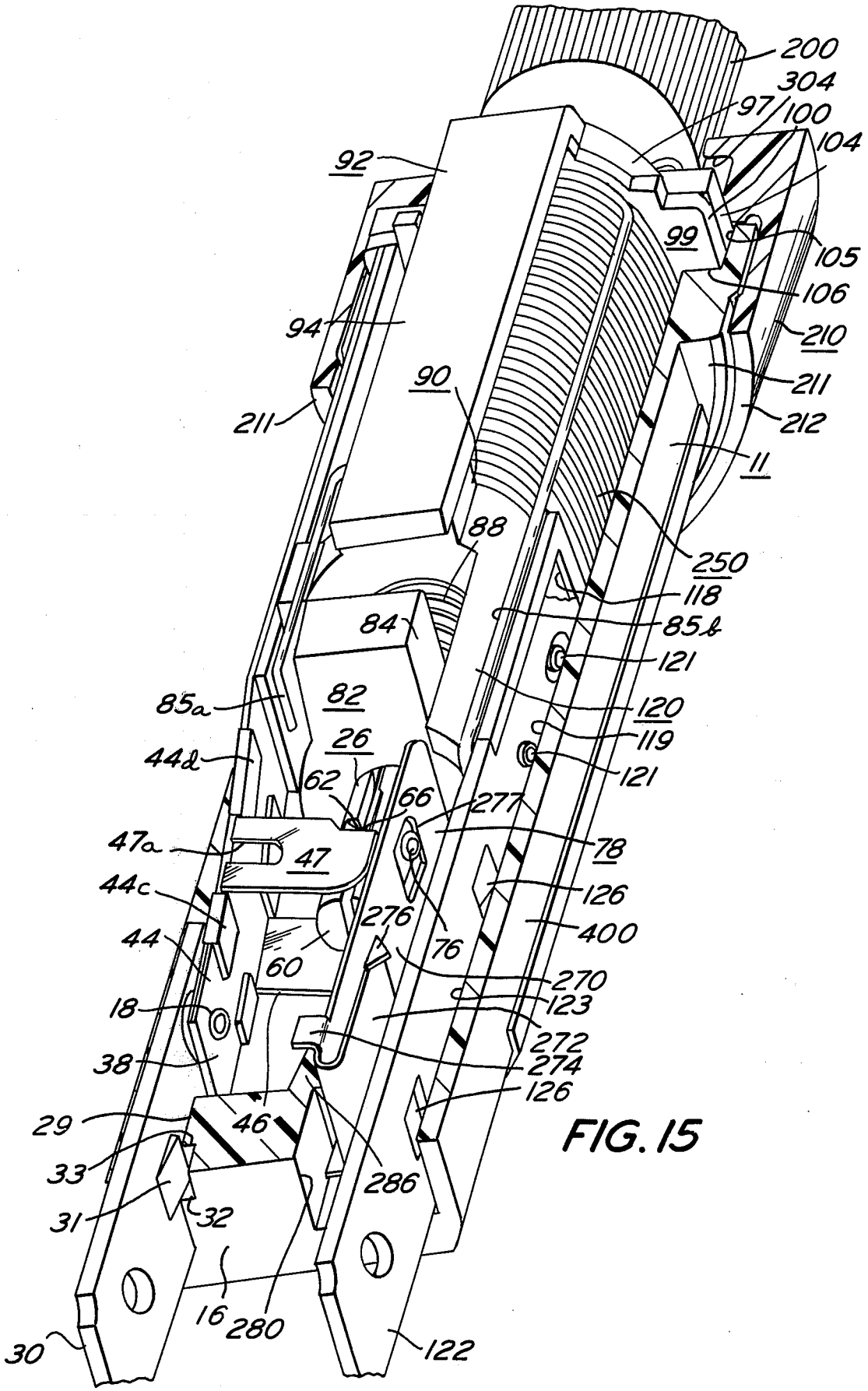
FIG. 15 is a bottom, perspective view in which the housing has been partially cut away to expose, for illustrative purposes, the time delay assembly and its associated parts, the view being taken in the contacts closed position.
Figure 21:
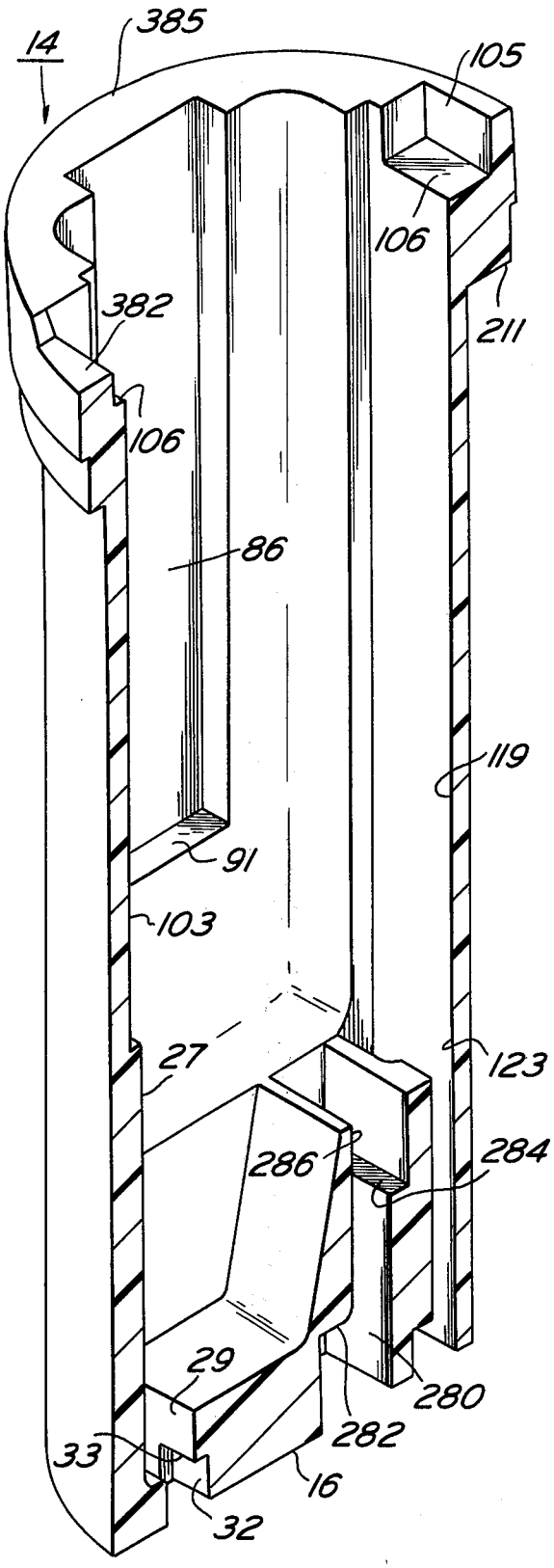
FIG. 21 is a top perspective view of the case shown in FIG. 20, one-half of the case being cut away to better show the internal walls thereof and the case has been rotated 180° relative to the illustration of FIG. 20.
Figure 20:
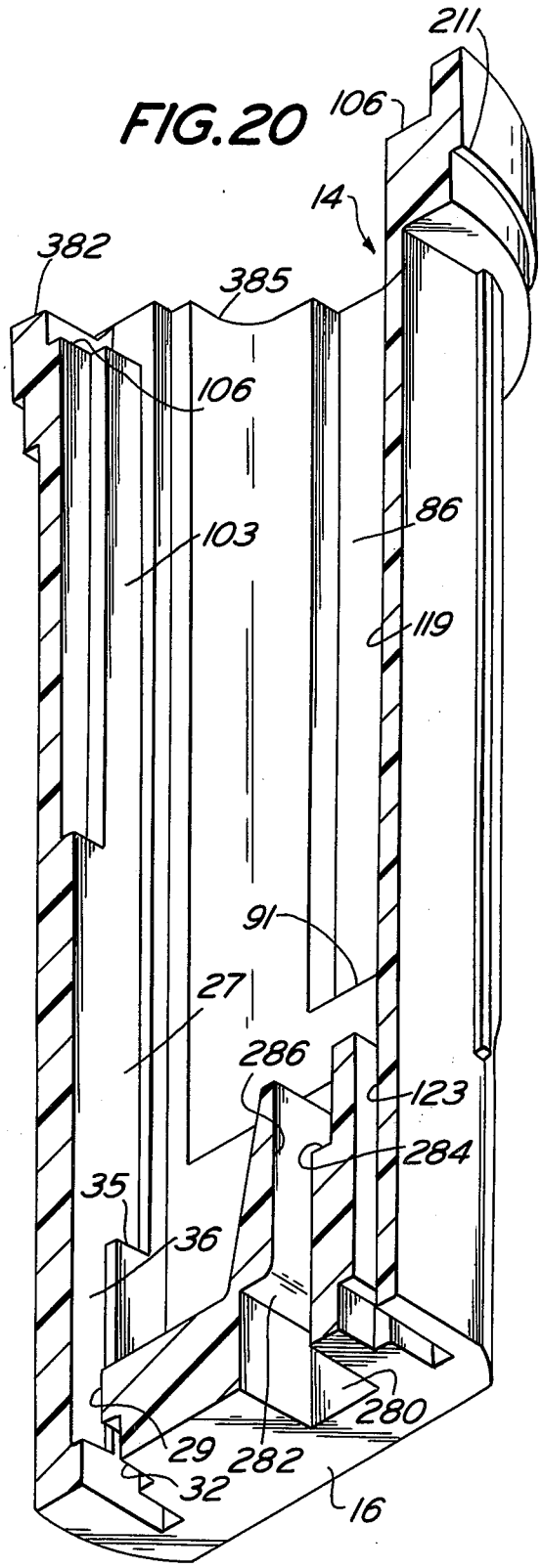
FIG. 20 is a bottom perspective view of the case, one-half of the case being cut away to better show the internal walls thereof.

To so restrain the time delay assembly 26, the head 76 extends into a window or opening 279 formed in a leg 270 of the latch 78, the head 76 engaging a wall 277 when in the latched position, FIG. 15. The opening 279 is wide enough to permit the head 76 to be rotated during manual opening of the contacts, as hereinafter described, the head 76 sliding against the wall 277 as it so rotates.

The time delay assembly 26 is biased upwardly or outwardly, as viewed in FIGS. 3 and 4, out of the housing 11, by a return and reset spring 80.

Figure 8:
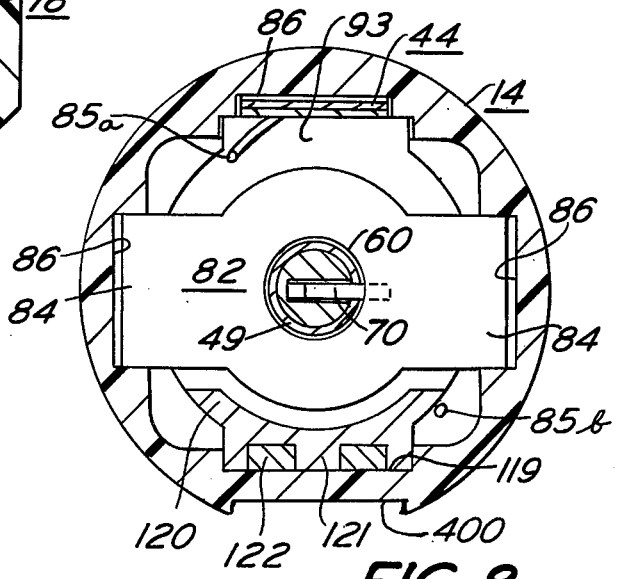

Surrounding the tube 49 and the extension 60, as shown in FIGS. 6, 8 and 15, and coaxial therewith is a linearly movable armature 82. The armature 82 is ring-shaped with two integral lugs 84 on opposite sides and is formed of a suitable magnetizable material. The two lugs 84 are received in two suitable channels 86 formed (180° apart) in the case 14, as shown in FIGS. 6 and 8. A spring 88 (FIG. 6) is also disposed around the tube 49 and is seated at one end against the armature 82 and at the other end against a shoulder 87 forming part of a recess 89 in the lower flange 93 of the bobbin 90. The lugs 84 are biased (by the spring 88) against and seated on shoulders 91 formed on the case 14 at the bottom of the two channels 86 when the armature 82 is in the position shown in FIG. 6.

Further, the armature 82 is symmetrical about the longitudinal axis of the tube 49 and made to fill as much of the cross sectional area (FIG. 6) as is practical, so as to result in a sufficient magnetic force thereon. Also, the armature 82 fits slidably about the elongated tube 49 and slidably in the elongated channels 86, so as to move toward and away from the coil 24, parallel to the longitudinal axis of the elongated tube 49, as shown in FIGS. 6 and 8. The armature 82 is guided axially by the tube 49 and is restrained against rotation about the tube 48 by virtue of the interfitting lugs 84 and channels 86 in the case 14. While the interfitting lugs 84 and channels 86 would provide both axial and anti-rotational guidance, by closely fitting the armature about the tube 49, better guidance of the armature 82 is achieved with less wobble. Thus, the armature 82 "floats" axially around the tube 49 in a predetermined path.

The solenoid coil 24 comprises a suitable number of turns of wire (suitably insulated from each other) wound about the bobbin 90 and having coil ends 85*a* and 85*b* suitably secured to the bracket 40 and terminal 122 (FIGS. 3 and 4), respectively. In the preferred embodiment, the bobbin 90 mates with a frame 92 formed of suitable magnetizable material. The frame 92 comprises two rails 94 extending along the length of the bobbin 90 toward the armature 82 and an inturned flange 96 all integral with a base 97. The rails 94 are slidably received and positioned in the channels 86 which have upper, open ends (the channels 86 also receiving the armature lugs 84 at their lower ends), thereby axially positioning the entire internal subassembly 250 (shown in FIG. 17) relative to the case 14.

The base 97 further includes two feet 104, as shown in FIGS. 3, 4, 13, 15 and 17, received in suitable slots 105 in the case 14, the base 97 resting on the flange 99. The flange 99 has two feet 100 which may or may not rest on the ledges 106 formed by the case 14 depending on manufacturing tolerances.

The base 97 (of the magnetic frame 92) also includes two elongated slots 101 (FIGS. 6 and 13) one of which receives an end 80*a* of the return and reset spring 80. The other end 80*b* of the return and reset spring 80 is received in one of several notches provided in the button 202, FIG. 6.

The recess 89 (at the lower end of the bobbin 90) is large enough to preferably receive a sleeve 98, of magnetizable material, which encircles the tube 49, and surrounds the core 50, to increase the magnetic efficiency of the circuit, as shown in FIG. 6. The sleeve 98 has a slot 95 extending part way along its length (FIGS. 5 and 10) to receive and accommodate the lever tail 72 when the time delay tube 49 is in its upper or contacts open position, i.e., the position shown in FIGS. 4 and 5.

The slot 95 in the sleeve 98 also functions to properly align the tube 49 relative to the wing 47 when the subassembly 250 (FIG. 17) is made as at such time the tail 72 is received in the slot 68.

The bobbin flange 99 has an opening 108 (FIGS. 3, 4 and 13) to receive the upper end of the bracket 40 and the frame base 97 has a similar opening 110 aligned with the opening 108 to receive the upper end of the bracket 40. The bracket 40 has an opening to receive a detent 102 projecting integrally with the lower flange 93 of the bobbin 90 to further secure the bracket 40 to the bobbin 90. To accommodate the detent 102, the channel 27 includes an upper enlarged portion 103, as shown in FIGS. 3 and 4.

The bobbin 90 also has a depending integral leg 120 extending downwardly, FIGS. 3, 4 and 15, and including two detent-like nibs 121 frictionally received within corresponding openings in the terminal 122, one of the openings being slightly elongated to facilitate assembly. Preferably the leg 120 has a recess 118 to receive the upper portion of the terminal 122, the latter being partially cut away in FIG. 15 to partially show the recess 118. The leg 120 is slidably received in an open ended channel 119 formed in the case 14. The terminal 122 extends through a slot 123 (aligned with, and a continuation of, the channel 119), the slot 123 being formed in the base 16. The terminal 122 has two bent-out lips 126 on opposite sides of the base 16 to position and secure the terminal 122 to the base 16.

The bobbin 90 is preferably of thermoplastic material and after the terminal 122 is assembled to the leg 120 the nibs 121 are heated and pressed so as to fill their openings and form a more rigid connection. Likewise, the detent 102 is heated and pressed to form a head securing the bracket 40 to the bobbin 90. Thus, the sub-assemblY 250 (FIG. 17) is secured to the base 16.

Depending on manufacturing tolerances, the feet 100 of the bobbin flange 99 may or may not abut the ledges 106.

The cover 210 includes a projection 380 (see FIGS. 3 and 18) which fits into a notch 382 in the case 14 to align the cover 210 relative to the time delay assembly 26. The projection 380 sits in the notch 382, but the peripheral surface 384 may or may not abut the base 97 and/or the upper end face 385 of the case 14, the surface 384 being shown spaced therefrom in FIGS. 3, 4, 5 and 6.

From the foregoing it is seen that most of the components may be assembled as a sub-assembly 250 outside of and independent of the case 14 and cover 210, the sub-assembly 250 being illustrated in FIG. 17. The sub-assembly 250 is formed about the bobbin 90 which carries the terminal 122 and the bracket 40, as shown in FIG. 17. The sub-assembly 250 may be tested outside of the housing 11 so that only minimal testing need be done after the circuit breaker 10 is fully assembled.

Further, in the preferred embodiment the coil 24, bobbin 90, magnetic frame 92 and time delay assembly 26 together substantially fill all of the cross-sectional space above the armature 82, as seen in FIGS. 3 and 4, making for a compact arrangement.

The electromagnetic sensing device thus comprises the coil 24, the bobbin 90, the magnetizable frame 92 and the time delay assembly 26.

If the circuit breaker 10 is in the position of FIGS. 1, 3 and 15, rotation of the cap 200 clockwise, as viewed in FIG. 1, will cause a cam or surface 206 (the cam 206 being an integral part of the extension 60) to push against the wing 47 and thereby lift the surface 66 off of the catch 62 (formed on the pole piece extension 60) causing the movable arm 38 to move to the position shown in FIG. 4. The movable arm 38 would move to the position shown in FIG. 4, even if the cap 200 is manually held depressed in the contacts closed position, i.e., the "trip free" position of FIG. 4. If the cap 200 is thereafter released, the time delay assembly 26 will move to the position shown in FIG. 4 due to the bias of the return and reset spring 80.

Figure 7:
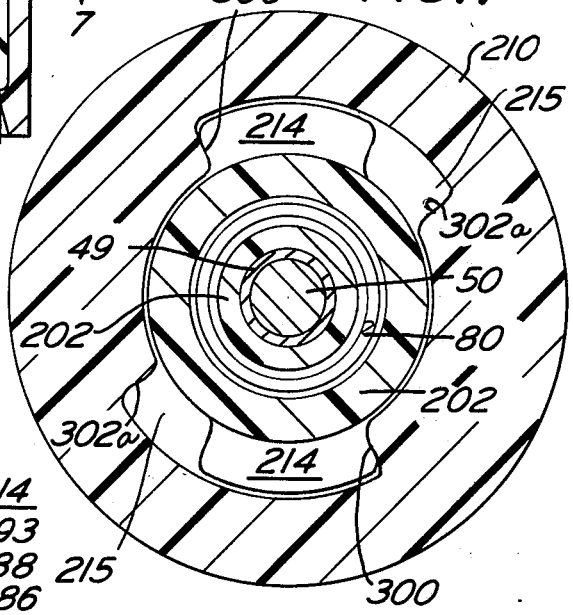
FIGS. 7 and 8 are cross-sectional views taken along the lines 7—7 and 8—8, respectively, in FIG. 6.

Surrounding the button 202 is the annular cover 210 abutting the upper end surface of the case 14, as shown in FIGS. 3, 4, 6 and 15 and having a depending stepped flange 212 mating with a conversely stepped annular flange 211 formed on the case 14. The inside wall of the cover 210 is formed with two elongated channels 215 (FIGS. 7 and 18) which receive ears 214 formed on the button 202 and extending radially outwardly into the channels 215. The two channels 215 are defined on one side by the two stop walls 300 and on the other side by the two stop walls 302, the walls 302 being stepped as shown. The engagement of the ears 214 with the stop walls 300 and 302 limits the rotation of the ears 214 and axial upward movement is limited by the end wall 304 shown in FIGS. 3, 4 and 19.

After the catch surface 62 releases the wing 47, the movable arm 38 moves from the position shown in FIG. 3 toward the position shown in FIG. 4. In so doing, the wings 46 and 47 engage the latch 78 and move it out of engagement with the head 76, freeing the time delay assembly 26 to move upwardly, as viewed in FIGS. 3 and 4. In the contacts closed position of FIG. 3, the time delay assembly 26 is biased counterclockwise, as viewed in FIG. 1, so that the ears 214 are biased toward the stop walls 300 and in abutment therewith. When the cap 200 is manually rotated clockwise, as viewed in FIG. 1, the ears 214 move from the walls 300 toward the stepped walls 302, the latter having stepped portions 302*a* and 302*b*. The cam surface 206 releases the wing 47 from the catch 62 at which time the time delay assembly 26 moves upwardly, as viewed in FIGS. 3 and 4, the ears 214 moving in the channels 215 toward and into the narrower arcuate space defined by the stop walls 300 and 302*b*.

The lever 70 is "freely" pivotal about the pin 74, i.e., there is no spring biasing the lever 70 to the position shown in FIG. 6. However, the lever 70 is maintained in the position shown in FIG. 6 (when the unit is energized below predetermined current values) by the wing 47, because the wing 47 is "toed-in" toward the extension 60 and bears against the flat surfaces 65 and 67. The wing 47 is thus prestressed against the pole piece extension 60 tending to maintain the wing 47 engaged against the catch 62, even if vibrational forces or other forces upon the circuit breaker should tend to urge the lever 70 counterclockwise, as viewed in FIG. 6. By contrast, the wing 46 is preferably spaced from the extension 60, as shown in FIGS. 6 and 12.

Thus, the force placed upon the lever 70 by the armature 82 has to be great enough to overcome the mass of the lever 70, its frictional restraint about the pin 74 and possibly the frictional restraint caused by contact between the lever 70 and the walls defining the slot 68, the mass of the wing 47, and the bias force of the wing 47 against the lever 70.

Figure 5:
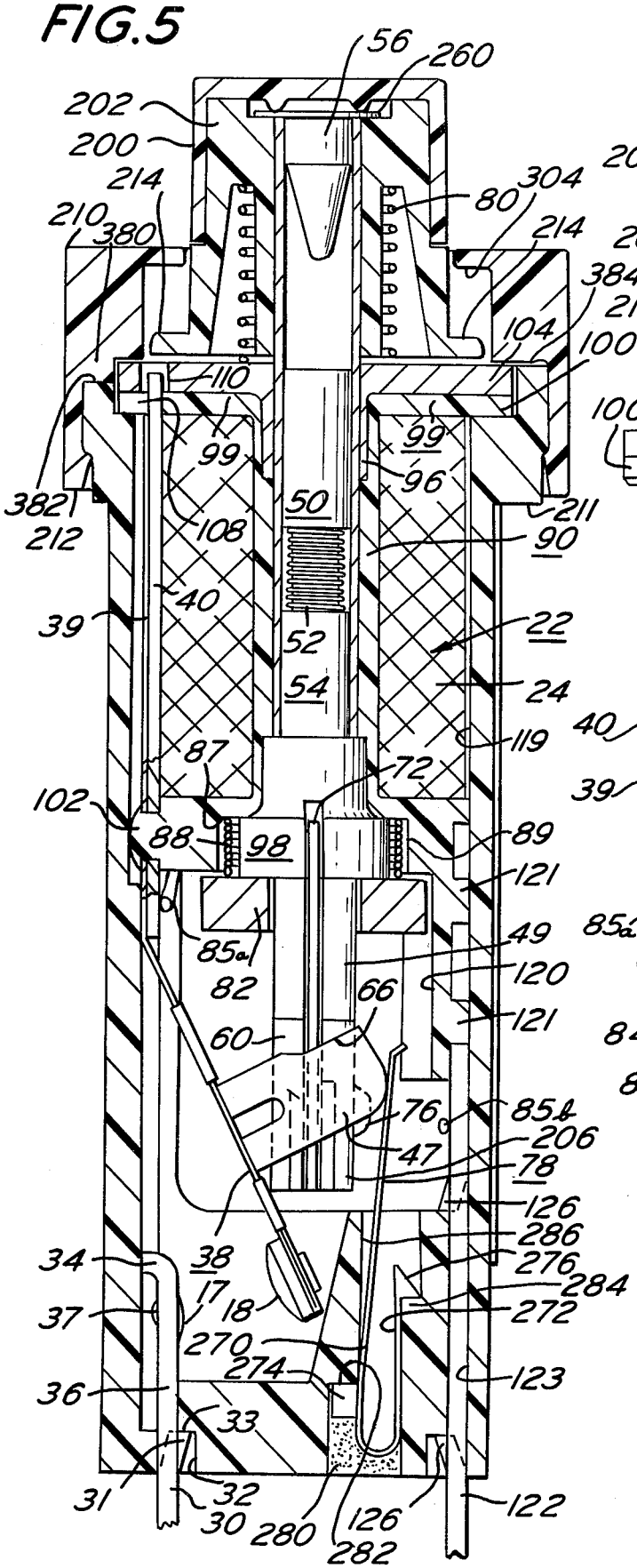
FIG. 5 is a sectional view, similar to FIGS. 3 and 4, but showing the "trip free" condition, i.e., the contacts are open, but the cap is being held manually in the contacts closed position.

Further, as shown in FIGS. 5 and 6, any tendency of the time delay assembly 26 to move outwardly (upwardly in FIG. 6) would result in engagement of the tail 72 with the sleeve 98 (at the upper end of the slot 95) restraining such movement. Such upward movement would also be restrained by the head 76 which would engage the armature 82 and push the armature against the lower end faces of the rails 94 of the frame 92.

When the sub-assembly 250 is assembled, the engagement of the tail 72 with the sleeve 98 keeps the tube 49 within the bobbin 90, as otherwise (until the cover 210 is assembled to the case 14) the time delay assembly 26 would be free to separate from the bobbin 90. The head 76 of the pin 74 may engage the armature 82 to also retain sub-assembly 250 (FIG. 6).

The bobbin 90, the sleeve 98, and the coil 24 are assembled together as another unit. The bracket 40 is also added to the bobbin 90 and the movable arm is preferably spot welded at its rear portion 39 to the bracket 40.

Preferably the tube 49, the pole piece 54, and the pole piece extension 60 are assembled together and then the slot 68 is cut into the extension 60, the tube 49 and the pole piece 54. Thereafter, the silicone liquid, the spring 52, the core 50 and the plug 56 are assembled together, the plug 56 being of non-magnetizable material and preferably welded to the tube 49, the tube 49 and the plug 56 being preferably both of brass material. The thus assembled tube 49 is placed through the bobbin 90 and the return and reset spring 80 is placed between the (frame) base 97 ad the button 202, the tension on the coil spring 80 being preferably adjusted, as required, by placing the spring end 80*b* in one of six circumferentially spaces holes (FIG. 6) in the button 202.

The plug 56 has a radially outwardly extending flange 260 with two oppositely disposed semi-circular openings 262, see FIGS. 9 and 18. The semi-circular openings 262 receive two corresponding projections 264 formed on the button 202, the interfitting semicircular openings 262 receive two corresponding projections 264 formed on the button 202, the interfitting semi-circular openings 262 and the projections 264 restraining rotation of the tube 49 relative to the button 202. The cap 200 is then placed over the button 202, as shown in FIG. 6, trapping the flange 260 between the cap 200 and the button 202.

Thus, the assembled tube 49, the button 202 and the cap 200 form one unitary member jointly movable.

The latch 78 further comprises a leg 272 which together with the leg 270 forms a flexible leaf having a general U-shape, as shown in FIGS. 3 and 4. The leg 270 extends parallel to the longitudinal axis of the tube 49 and is biased against a wall 286. The leg 270 also includes feet 274 bent therefrom at about a right angle to the leg 270. The leg 272 also includes feet 276. The latch 78 is inserted into a slot 280 in the base 16 until the feet 274 abut the wall 282 and the feet 276 snap over the wall 284 to thereby trap the latch 78 to the base 16. Preferably the legs 270 and 272 are prestressed apart prior to insertion into the base 16 and the leg 270 includes a slot 271 to increase its flexibility. The base 16 preferably extends upwardly, as shown in FIGS. 3 and 4, to provide the wall 286 which supports and aligns the leg 270 relative to the tube 49.

To assemble the unit, the terminal 30 is inserted through the top (as seen in FIG. 3) into the case 14. The sub-assembly 250 illustrated in FIG. 17 is then inserted into the case 14. The latch 78 is then inserted from the bottom.

Preferably, a sealing electrically insulating compound is placed in the slot 280, after the latch 78 is in proper position, to electrically insulate the otherwise exposed portion thereof.

As best illustrated in FIGS. 16 and 19, the movable arm 38 is formed from a single flat and relatively thin piece of sheet metal (preferably a copper tempered alloy) stamped to provide the forward section 44 with a section 44*a* bent up and pressed against the remainder section 44*b*. The section 44*b* includes two tabs 44*c* and two tabs 44*d* bent around the remainder section 44*b*, as shown, and on opposite sides of the wings 46 and 47.

Thus, a zone is created at the juncture of the integral sections 39 and 44*a* which is flexible relative to the forward part of the movable arm 38 which, because of the overlying sections 44*a* and 44*b* and the four securing tabs 44*c* and 44*d*, is more rigid. Thus, when the catch 62 engages the edge 66, the movable arm 38 is easily flexed toward the stationary contact 17, yet the rigidity of the forward portion 44 assures adequate contact pressure.

The bracket 40 is thick relative to the thickness of the movable arm 38 and functions as a heat sink to remove heat from the zone of flexure between the sections 39 and 44*a*. The tabs 44*c* and 44*d* also serve to increase the mass of the movable arm 38 and also aid in reducing the concentration of heat at the flexure zone, thereby maintaining the flexibility of the movable arm 38 at this zone.

The wing 47 is required to be flexible enough to easily disengage the catch 62 when the time delay assembly 26 is rotated. As previously described, at such time the surface 206 engages the wing 47 pushing or flexing it outwardly. To assume such flexibility, the slot 47*a* is cut into the wing 47. However, the wing 47 is also rigid enough (in a plane parallel to the lengthwise movement of the time delay assembly 26) to transmit the closing force from the time delay assembly 26 to the movable contact 18. It should also be noted that the relatively large wings 46 and 47 also function as heat radiators tending to maintain the temperature of the movable arm 38 at an acceptable amount.

Thus, a movable arm 38 is provided having sufficient mass to assure its current carrying ability without undue overheating, flexible enough to be moved from the contacts closed to the contacts open position, having enough resilience to spring to the contacts open position without the need for a separate spring to assist it (when the catch 62 is disengaged from the edge 66) and rigid enough to assure adequate contact pressure when the contacts are closed.

As shown in FIGS. 1 and 2, preferably the circuit breaker has a generally cylindrical outer appearance. The cap 200 and the cover 210 are both cylindrical in outer appearance and of plastic, electrical insulating, materials. The case 14 has a cylindrical outer appearance except for a flat surface 400 on one side, as shown in FIGS. 2, 8, 10 and 12. The flat surface 400 provides an anti-rotational feature when the circuit breaker is installed in a panel.

Also, comparing FIGS. 1 and 2 it is seen that the cap 200 has a serrated or color coated major upper portion and an unserrated or differently colored lower portion. When the cap 200 is in the contacts open position of FIG. 2 its unserrated lower portion is exposed (above the cover 210) to provide an easily seen indication that the circuit breaker is in its "off" position.

"ON" TO "OFF" MANUALLY

Assuming the circuit breaker 10 to be in the contacts closed position of FIG. 3, to manually move the movable contact 18 from the contacts closed position to the contacts open position of FIG. 4, the cap 200 is grasped and rotated clockwise, as viewed in FIG. 1. Such rotation will rotate the entire time delay assembly 26 and after about 20° of rotation, the assembly starts to move outwardly and upwardly under pressure of the return and reset spring 80. In the depressed position of the cap 200, the total rotation of the cap 200 is limited to about 30° (from stop walls 300 to stop walls 302*a*).

When the cap 200 is so rotated, the entire time delay assembly 26, shown in FIGS. 3 and 4, rotates. The time delay assembly 26 comprises, as heretofore described, the tube 49, the extension 60, the pole piece 54, the plug 56, the spring 52, movable core 50, the silicone liquid, the button 202, the cap 200, and the lever 70 together with its pin 74. The return and reset spring 80 biases the bottom 202 upwardly and counterclockwise and, hence, the entire time delay assembly 26 is biased upwardly and counterclockwise, as viewed in FIG. 1.

The return and reset spring 80 first rotates the button 202 counterclockwise, FIG. 1, and then moves the button 202 axially and upwardly (as viewed in FIGS. 3 and 4) from the position of FIG. 3 to the position shown in FIG. 4.

"OFF" TO "ON" MANUALLY

Referring to FIGS. 2 and 4, the cap 200 is pushed down to move from the "off" to the "on" contacts position. The ears 214 of the button 202 then ride down in the channels 215 in the cover 210, against the walls 300, since the ears 214 are biased toward the walls 300 by the spring 80. The downward travel is limited by the button 202 contacting the base 97 of the magnetic frame 92. (An alternative would be for the lower end portion of the pole piece extension 60 to engage the wall 286 at the lower end of the case 14.) Meanwhile, as the time delay assembly 26 is moving down the catch surface 62 of the pole piece extension 60 engages the edge 66 of the wing 47. The edge 66 of the wing 47 then slides along the catch surface 62, while simultaneously the movable arm 38 is flexed toward and into engagement with the stationary contact 17, the latch 78 flexes from the position shown in FIG. 4 to that shown in FIG. 3. At such time, the head 76 of the pin 74 enters the opening 279 in the latch 78, restraining upward movement of the time delay assembly 26, see FIG. 13, by engagement of the wall 277 with the catch 76.

The channels 215 have narrow portions defined by the space between walls 300 and 302*b* to guide the time delay assembly 26 in its travel downwardly, as viewed in FIGS. 3 and 4, and restrict rotation of the time delay assembly 26 to assure that the catch 62 of the time delay tube 49 will engage the wing 47, and latch when the head 76 enters the window 279 of the latch 78.

Further, the narrow portion of the channels 215 (defined by the spaces between the walls 300 and 302*b*) prevents rotation of the time delay assembly 26 when in its "off" position. Rotation at such time is not desired as engagement of the lever 70 with the sleeve 98 would occur. The walls 300 and 302*b* are spaced apart sufficiently to provide slidable movement of the ears 214 therebetween.

"ON" TO "OFF" ELECTRICALLY

On overload, the armature 82 will move up against the bias of the armature spring 88, see FIGS. 3 and 5. The armature 82 moves about half-way up when the armature 82 starts to engage the inclined tail 72 of the trip lever 70. The trip lever 70 is pivotally carried (about the latch pin 74) in the slot 68 formed in the pole piece extension 60, the tube 49, and the pole piece 54. As the armature 82 continues to move up, see FIG.

5, the trip lever 70 is rotated counterclockwise (FIG. 6) about the pin 74. After the lever 70 is sufficiently rotated counterclockwise, the short arm 222 of the lever 70 presses outwardly against the wing 47 of the movable arm 38, causing the wing 47 to move off of the catch surface 62 (of the pole piece extension 60), this movement being up out of the plane of the paper in FIG. 3. When the wing 47 moves off of the catch surface 62, the arm 38 moves from the position of FIG. 3 toward the "off" position shown in FIG. 4. In so doing, the wings 46 and 47 both engage the latch 78 (FIG. 12) and move the latch 78 to the right in FIGS. 3 and 4, releasing the head of the latch pin 74 from the latch 78. Whereupon the time delay assembly 26 is free to move up under the bias of the return and reset spring 80, the unit then moving to the full "off" position, FIG. 4.

While the invention has been described as including a time delay assembly 26, it is seen that if the tube 49 is made solid, a circuit breaker will be provided which will open an overload with virtually no time delay.

Further, the circuit breaker described may function as only a switch to manually open and close the circuit and for this purpose the coil 24 and associated electrical sensing elements may be omitted.

It should be noted that the time delay assembly 26 extends outwardly of the case 14 to provide a portion which may be grasped for manual operation and that the cover 210 and ears 214 could be omitted. If the cover 210 and ears 214 are omitted, when the circuit breaker is in the contacts closed position, FIG. 3, rotation clockwise or counterclockwise would cause the extension 60 to engage the wing 47 and release it from the catch 62.

In the invention, the movable arm 38 forms part of the latching mechanism by virtue of the integral wing 47, thus eliminating a separate latching mechanism.

Also, the lever 70 provides a torque multiplication so that the relatively low force output of the electromagnetic sensing device 22, primarily the coil 24 and the armature 82, is sufficient to disengage the wing 47 from the catch 62. It should be noted that as part of the electromagnetic sensing device 22, the rails 94 function as magnetic flux carrying members.

Having described the invention, what we claim is:

1. A circuit breaker comprising
a housing,
a pair of contacts enclosed by said housing,
a movable arm within said housing and carrying one of said contacts, and
an electromagnetic sensing device comprising
a coil within said housing
a member movable between a first contacts closed position and a second contacts open position,
an armature movably supported within said housing,
a first latching means operatively connecting said member and said movable arm for maintaining said movable arm in said first contacts closed position, for returning said movable arm to said first contacts closed position, and for permitting said movable arm to move to said second contacts open position upon release of said first latching means,
said armature being operatively connected to said first latching means to unlatch said movable arm on sufficient energization of said coil, and
second latching means for maintaining said member in said first contacts closed position and operatively connected to said first latching means for releasing said member and permitting said member to move to said second contacts open position after said first latching means is released.

2. The combination of claim 1 and further including
a spring to move said member to said second position after said second latch is released.

3. The combination of claim 1 wherein
said member is rotatable and has a portion engaging said first latching means during said rotation,
whereby said first latching means is released and moves to said second contacts open position.

4. The combination of claim 1 wherein said member is an elongated tube.

5. The combination of claim 1 wherein said coil is fixed within said housing.

6. The combination of claim 2 wherein
said member is rotatable and has a portion engaging said first latching means during said rotation,
whereby said first latching means is released and moves to said second contacts open position,
said member is an elongated tube, and said coil is fixed within said housing.

7. The combination of claim 6 wherein
said elongated tube includes a movable magnetizable core and a liquid to retard the movement of said core.

8. The combination of claim 7 wherein said first latching means comprises
a catch carried by said tube and engageable with said movable arm.

9. The combination of claim 8 and further including
a lever pivotally carried by said tube to disengage said movable arm from said catch.

10. The combination of claim 8 wherein
said second latching means comprises
a flexible leaf restrained by a projection carried by said tube.

11. The combination of claim 10 wherein
said movable arm includes
a wing extending toward said elongated tube and engaging said catch.

12. The combination of claim 11 wherein
said elongated tube has a portion engaging said first latching means upon rotation of said elongated tube to release said wing from said catch and thereby also permit said movable arm and said elongated tube to both move to their second positions.

13. The combination recited in claim 1 wherein
said second latching means includes
a detent carried by said member, and
a latch restrained by said detent,
said movable arm engaging said latch and moving it out of restraining engagement with said detent when
said movable arm is released from said member,
said member being spring biased away from said latch,
whereupon said member moves to its open position upon release of said detent from said latch.

14. The combination recited in claim 13 wherein
said member is rotatable and has a portion engaging said first latching means during said rotation,
whereby said first latching means is released and moves to said second contacts open position.

15. The combination recited in claim 13 wherein said member is an elongated tube.

16. The combination recited in claim 13 wherein said coil is fixed within said housing.

17. The combination recited in claim 13 wherein
said member is rotatable and has a portion engaging said first latching means to release the latter,
said member is an elongated tube,
said coil is fixed within said housing.

18. The combination recited in claim 14 wherein said coil is fixed within said housing.

19. The combination recited in claim 6 wherein
said housing including an elongated case having an open end, and
said elongated tube extending partially out of said case through said open end.

20. The combination recited in claim 19 and further including
a cover cooperating with and partially closing said open end, said elongated tube extending through said cover,
a button carried by said tube and cooperating with said cover to limit axial movement of said elongated tube outwardly of said housing and to limit rotational movement of said elongated tube.

21. The combination recited in claim 20 wherein
said button has an ear, and
said cover includes a channel for receiving said ear.

22. The combination recited in claim 9 wherein
said elongated tube including a magnetizable pole piece,
said elongated tube including a slot within which said lever is pivotally mounted,
said armature surrounding said elongated tube and being movable axially along the longitudinal axis toward the coil thereof upon predetermined electrical conditions,
said lever having a tail engaged by said armature upon sufficient movement of said armature to pivot said lever,
said lever having a projection engaging said movable arm upon sufficient pivotal movement of said lever, whereby
said movable arm moves from said first contacts closed position toward said second contacts open position and releases said second latching means resulting in movement of said elongated tube outwardly of said housing.

23. The combination recited in claim 22 wherein
said second latching means comprises
a projection carried by said tube, and
a flexible leaf restrained by said projection.

24. The combination recited in claim 23 wherein
said movable arm includes
a wing extending toward said elongated tube and engaging said catch.

25. The combination recited in claim 24 wherein
said elongated tube has a portion engaging said first latching means upon rotation of said elongated tube to release said wing from said catch and thereby also permit said movable arm and said elongated tube to both move to their second positions.

26. The combination recited in claim 25 wherein
said second latching means includes
a detent carried by said member, and
a latch restrained by said detent,
said movable arm engaging said latch and moving it out of restraining engagement with said detent when said movable arm is released from said member,
said member being spring biased away from said latch, whereupon
said member moving to its open position upon release of said detent from said latch.

27. The combination recited in claim 26 wherein
said case includes a wall against which said armature is seated, and
a second spring biasing said armature against said wall.

28. The combination recited in claim 27 wherein
a pin pivotally connects said lever to said tube, and said pin also forming said detent.

29. The combination recited in claim 28 wherein
said lever is disposed in the longitudinal plane of said elongated tube.

30. An electromagnetic device comprising
a movable arm,
a coil,
a member associated with said coil and movable relative thereto between a first position engaging said movable arm and a second position disengaged from said movable arm,
an armature associated with said coil and movable relative thereto,
first latching means operatively connecting said member and said movable arm to maintain said movable arm in said first engaged position, to return said movable arm to its first engaged position, and to permit said movable arm to move to said second disengaged position upon release of said first latching means,
said armature being operatively connected to said first latching means to unlatch said movable arm on sufficient energization of said coil, and
second latching means for maintaining said member in its first engaged position and operatively connected to said first latching means for releasing said member and permitting it to move to said second disengage position after said first latching means is released.

31. The combination of claim 30 and a spring to move said member to its second position after said second latch is released.

32. The combination of claim 30 wherein
said member is rotatable and has a portion engaging said first latching means to release the latter and thereby also permit the movable arm and said member to both move to their second positions.

33. The combination of claim 30 wherein
said first latching means comprises a lever pivotally carried by said member and a catch carried by said member.

34. The combination of claim 30 wherein
said member is in the form of a tube.

35. The combination of claim 30 wherein
said member includes a time delay device.

36. The combination of claim 30 wherein
said member includes a magnetizable core for virtually instantaneous actuation of said armature with virtually no time delay.

37. The combination of claim 31 wherein
said member is rotatable and has a portion engaging said first latching means to release the latter and thereby also permit the movable arm and said member to both move to their second positions.

38. The combination of claim 34 wherein
said armature surrounds said tube and is movable toward said coil on predetermined energization thereof and away therefrom when said coil is deenergized.

39. The combination of claim 38 and further including
a housing,
said coil being fixed within said housing,
said tube extends in part out of said housing,
a spring biasing said tube outwardly of said housing, and
said housing including stop means for limiting outward movement of said tube.

40. A circuit breaker comprising
a housing,
a first terminal secured to said housing, said first terminal including a stationary contact,
a latch secured to said housing,
a sub-assembly secured to said housing,
said sub-assembly comprising
a second terminal,
a movable arm including a movable contact,
an electromagnetic sensing device comprising,
a coil fixed within said housing,
an armature associated with said coil,
a member movable relative to said coil,
said member and movable arm being in a first force transmitting relationship and movable to a second non-force transmitting relationship,
said contacts being closed when said member and said movable arm are in said first force transmitting relationship,
said contacts being open when said member and said movable arm are in said second non-force transmitting relationship,
said latch restraining said member in said first force transmitting relationship,
said armature being operatively associated with said latch to remove the restraint on said member upon predetermined energization of said coil.

41. The combination of claim 40 wherein
said housing includes a base, and
said first terminal and said latch are both secured to said base.

42. The combination of claim 40 wherein
said latch includes a flexible leaf,
said flexible leaf defines a latch wall,
said member includes a detent restrained by said wall when said leaf is in a first position and out of restraining engagement therewith when said leaf is in a second position.

43. The combination of claim 40 wherein
said member is rotatable relative to said movable arm from its first force transmitting relationship to its second non-force transmitting relationship.

44. The combination of claim 40 wherein
said housing includes a case and a cover,
said member extending partially out of said cover,
said cover having wall means to limit movement of said member outwardly of said housing and to limit rotational movement of said member.

45. The combination of claim 40 wherein said member includes a time delay assembly.

46. The combination of claim 40 wherein
said member includes a pivotal lever, and
said armature engaging said lever, when said armature is attracted by said coil on predetermined electrical conditions, and pivoting said lever into engagement with said movable arm to move the latter from its first force transmitting relationship with said member to its second non-force transmitting relationship therewith.

47. The combination of claim 41 wherein
said latch includes a flexible leaf,
said flexible leaf defines a latch wall,
said member includes a detent restrained by said wall when said leaf is in a first position and out of restraining engagement therewith when said leaf is in a second position.

48. The combination of claim 41 wherein
said member is rotatable relative to said movable arm from its first force transmitting relationship to its second non-force transmitting relationship.

49. The combination of claim 41 wherein
said housing includes a case and a cover,
said member extending partially out of said cover,
said cover having wall means to limit movement of said member outwardly of said housing and to limit rotational movement of said member.

50. The combination of claim 41 wherein said member includes a time delay assembly.

51. The combination of claim 41 wherein
said member includes a pivotal lever, and
said armature engaging said lever, when said armature is attracted by said coil on predetermined electrical conditions, and pivoting said lever into engagement with said movable arm to move the latter from its first force transmitting relationship with said member to its second non-force transmitting relationship therewith.

52. The combination of claim 48 wherein
said housing includes a case and a cover,
said member extending partially out of said cover,
said cover having wall means to limit movement of said member outwardly of said housing and to limit rotational movement of said member.

53. The combination of claim 52 wherein said member includes a time delay assembly.

54. The combination of claim 53 wherein
said member includes a pivotal lever, and
said armature engaging said lever, when said armature is attracted by said coil on predetermined electrical conditions, and pivoting said lever into engagement with said movable arm to move the latter from its first force transmitting relationship with said member to its second non-force transmitting relationship therewith.

55. The combination of claim 53 wherein
said time delay assembly includes
an elongated tube,
a magnetizable pole piece at one end of said elongated tube,
a fluid within said tube, and
a magnetizable core movable toward said magnetizable pole piece against the retarding effect of said fluid.

56. The combination of claim 52 wherein
said housing includes a case and a cover,
said member extends partially out of said cover,
said cover has wall means to limit movement of said member outwardly of said housing and to limit rotational movement of said member, wherein said member includes a time delay assembly,
said member includes a pivotal lever,
said armature engages said lever, when said armature is attracted by said coil on predetermined electrical conditions, and pivots said lever into engagement with said movable arm to move the latter from its first force transmitting relationship with said member to its second non-force transmitting relationship therewith,
said time delay assembly includes
an elongated tube,
a magnetizable pole piece at one end of said elongated tube,
a fluid within said tube,
a magnetizable core movable toward said magnetizable pole piece against the retarding effect of said fluid, and
a spring to reset said core.

57. The combination of claim 50 wherein
said housing includes a case and a cover,
said member extending partially out of said cover,
said cover having wall means to limit movement of said member outwardly of said housing and to limit rotational movement of said member.

58. The combination of claim 57 wherein said member includes a time delay assembly.

59. The combination of claim 57 wherein
said member includes a pivotal lever, and
said armature engaging said lever, when said armature is attracted by said coil on predetermined electrical conditions, and pivoting said lever into engagement with said movable arm to move the latter from its first force transmitting relationship with said member to its second non-force transmitting relationship therewith.

60. A circuit breaker comprising
a housing,
a first terminal secured to said housing and including a stationary contact,
a movable arm including a movable contact engageable with said stationary contact,
latch means operatively connected to said movable arm to hold said contacts in engagement, and
an electromagnetic sensing device comprising
a coil,
a member movable axially between a first position and second position,
an armature movable relative to said member,
a lever carried by said member and movable between first and second positions in response to movement of said armature,
said armature being operatively connected to said lever to move said lever on sufficient energization of said coil,
movement of said lever to said second position unlatching said latch means, whereupon said contacts disengage, and
a second terminal electrically connected to said coil.

61. The combination of claim 60 wherein
said housing includes a base, and
said first terminal and said latch means are both secured to said base.

62. The combination of claim 60 wherein
said latch means includes a flexible leaf,
said flexible leaf defines a latch wall,
said member includes a detent restrained by said wall when said leaf is in a first position and out of restraining engagement therewith when said leaf is in a second position.

63. The combination of claim 60 wherein
said member is rotatable relative to said movable arm from a first force transmitting relationship to a second non-force transmitting relationship.

64. The combination of claim 60 wherein
said housing includes a case and a cover,
said member extending partially out of said cover,
said cover having wall means to limit movement of said member outwardly of said housing and to limit rotational movement of said member.

65. The combination of claim 60 wherein said member includes a time delay assembly.

66. The combination of claim 60 wherein
said armature engages said lever, when said armature is attracted by said coil on predetermined electrical conditions, and pivots said lever into engagement with said movable arm to move the latter from a first force transmitting relationship with said member to second non-force transmitting relationship therewith.

67. The combination of claim 61 wherein
said latch means includes a flexible leaf,
said flexible leaf defines a latch wall,
said member includes a detent restrained by said wall when said leaf is in a first position and out of restraining engagement therewith when said leaf is in a second position.

68. The combination of claim 61 wherein
said member is rotatable relative to said movable arm from a first force transmitting relationship to a second non-force transmitting relationship.

69. The combination of claim 61 wherein
said housing includes a case and a cover,
said member extending partially out of said cover,
said cover having wall means to limit movement of said member outwardly of said housing and to limit rotational movement of said member.

70. The combination of claim 61 wherein said member includes a time delay assembly.

71. The combination of claim 61 wherein
said armature engages said lever, when said armature is attracted by said coil on predetermined electrical conditions, and pivots said lever into engagement with said movable arm to move the latter from a first force transmitting relationship with said member to a second non-force transmitting relationship therewith.

72. The combination of claim 68 wherein
said housing includes a case and a cover,
said member extending partially out of said cover,
said cover having wall means to limit movement of said member outwardly of said housing and to limit rotational movement of said member.

73. The combination of claim 72 wherein said member includes a time delay assembly.

74. The combination of claim 73 wherein
said armature engages said lever, when said armature is attracted by said coil on predetermined electrical conditions, and pivots said lever into engagement with said movable arm to move the latter from a first force transmitting relationship with said member to a second non-force transmitting relationship therewith.

75. The combination of claim 73 wherein said time delay assembly includes
an elongated tube,
a magnetizable pole piece at one end of said elongated tube,
a fluid within said tube, and
a magnetizable core movable toward said magnetizable pole piece against the retarding effect of said fluid.

76. The combination of claim 72 wherein
said housing includes a case and a cover,
said member extending partially out of said cover,
said cover having wall means to limit movement of said member outwardly of said housing and to limit rotational movement of said member, wherein said member includes a time delay assembly,
said armature engages said lever, when said armature is attracted by said coil on predetermined electrical conditions, and pivots said lever into engagement with said movable arm to move the latter from a first force transmitting relationship with said member to a second non-force transmitting relationship therewith,
said time delay assembly includes
an elongated tube,
a magnetizable pole piece at one end of said elongated tube,
a fluid within said tube, and
a magnetizable core movable toward said magnetizable pole piece against the retarding effect of said fluid.

77. The combination of claim 70 wherein
said housing includes a case and a cover,
said member extending partially out of said cover,
said cover having wall means to limit movement of said member outwardly of said housing and to limit rotational movement of said member.

78. The combination of claim 77 wherein said member includes a time delay assembly.

79. The combination of claim 77 wherein
said armature engages said lever, when said armature is attracted by said coil on predetermined electrical conditions, and pivoting said lever into engagement with said movable arm to move the latter from a first force transmitting relationship with said member to a second non-force transmitting relationship therewith.

* * * * *